US009979119B2

(12) United States Patent
Saur

(10) Patent No.: US 9,979,119 B2
(45) Date of Patent: May 22, 2018

(54) END-POSITION FIXING OF A PLUG-IN CONNECTION FOR INCREASING THE VIBRATION RESISTANCE

(71) Applicant: Robert Bosch GmbH, Stuttgart (DE)

(72) Inventor: Martin Saur, Salach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days. days.

(21) Appl. No.: 14/909,222

(22) PCT Filed: Jun. 17, 2014

(86) PCT No.: PCT/EP2014/062756

§ 371 (c)(1),
(2) Date: Feb. 1, 2016

(87) PCT Pub. No.: WO2015/014533

PCT Pub. Date: Feb. 5, 2015

(65) Prior Publication Data

US 2016/0190729 A1 Jun. 30, 2016

(30) Foreign Application Priority Data

Jul. 31, 2013 (DE) ..... 10 2013 214 947

(51) Int. Cl.
*H01R 13/62* (2006.01)
*H01R 13/533* (2006.01)
(Continued)

(52) U.S. Cl.
CPC ..... *H01R 13/533* (2013.01); *H01R 13/58* (2013.01); *H01R 13/62933* (2013.01);
(Continued)

(58) Field of Classification Search
CPC ..... H01R 13/633; H01R 13/62938; H01R 13/6275; H01R 13/6295; H01R 13/62933
(Continued)

(56) References Cited

U.S. PATENT DOCUMENTS 4,840,574 A * 6/1989 Mills ..... B23K 9/323 439/157
5,135,408 A * 8/1992 Suzuki ..... H01R 13/639 439/157
(Continued)

FOREIGN PATENT DOCUMENTS

JP H05 17961 3/1993
JP H0517961 U 3/1993
WO WO 2011/079991 7/2011

*Primary Examiner* — Thanh Tam Le
(74) *Attorney, Agent, or Firm* — Norton Rose Fulbright US LLP

(57) ABSTRACT

A plug system for high-current plug-in connections includes a cable harness plug including an electrical line, and a unit including an interface for establishing an electrical connection between the cable harness plug and the unit. The plug system also includes a first fixing element for fixing the cable harness plug to the interface in a form-locked manner. The plug system also includes a second fixing element which is configured for fixing the cable harness plug and/or the line to the unit in a form-locked manner so that a movement of the cable harness plug and/or of the line in parallel and perpendicularly to a mating direction of the cable harness plug is prevented.

18 Claims, 10 Drawing Sheets

(51) Int. Cl.
*H01R 13/629* (2006.01)
*H01R 13/639* (2006.01)
*H01R 13/73* (2006.01)
*H01R 43/26* (2006.01)
*H01R 13/58* (2006.01)

(52) U.S. Cl.
CPC ..... *H01R 13/639* (2013.01); *H01R 13/73* (2013.01); *H01R 43/26* (2013.01); *H01R 13/5804* (2013.01); *H01R 2201/26* (2013.01)

(58) Field of Classification Search
USPC ..... 439/152, 157, 160, 345, 370, 371, 372
See application file for complete search history.

(56) References Cited

U.S. PATENT DOCUMENTS 5,308,255 A * 5/1994 Yamanashi ..... H01R 13/62933 439/157
5,322,448 A * 6/1994 Hahn ..... H01R 13/62944 439/153
5,344,194 A * 9/1994 Hatagishi ..... H01R 13/62933 285/26
5,551,885 A * 9/1996 Yamanashi ..... H01R 13/62933 439/157
6,273,756 B1 * 8/2001 Ward ..... H01R 13/6596 439/372
6,683,789 B1 * 1/2004 Sheynis ..... H05K 5/0069 361/752
6,913,474 B2 * 7/2005 Mikhail ..... H01R 13/62933 439/157
7,354,297 B2 * 4/2008 Tsukashima ..... H01R 13/595 439/368
7,367,825 B2 * 5/2008 Tsukashima ..... H01R 13/62977 439/157
7,413,464 B1 * 8/2008 Chen ..... H01R 4/2433 439/404
7,462,060 B2 * 12/2008 Hamoignon ..... H01R 4/2412 439/157
7,686,631 B1 * 3/2010 Eow ..... H01R 13/62938 439/157
8,105,099 B2 * 1/2012 Suzuki ..... H01R 13/193 439/157

* cited by examiner

END-POSITION FIXING OF A PLUG-IN CONNECTION FOR INCREASING THE VIBRATION RESISTANCE

FIELD OF THE INVENTION

The present invention relates to end-position fixing of a plug-in connection for increasing vibration resistance.

BACKGROUND INFORMATION

Electrical plug-in connections are used in many areas of technology. They generally include a contact carrier having an electrical contact. The contact carrier may be configured as a socket, and may accommodate a plug or pin for establishing an electrical connection. An electrical line leaves the contact carrier in the form of a cable, for example, and connects the electrical contact to further components.

For example, plug-in connections of this type may be used for connecting various components in a motor vehicle. The contact carrier may be configured as a cable harness plug, for example. The plug-in connections may be exposed to high stresses, in particular vibrations, during operation of the motor vehicle.

Movements may be transmitted to the plug-in connection via the cable or the electrical line. This may result in a relative movement between the electrical contact, directly connected to the electrical line, and a pin. Such relative movements may result in wear on the contact carrier, and thus, in a higher transfer resistance and a shorter service life of the contact carrier. The wear may be particularly pronounced in plug-in connections having relatively large dimensions and large lines, which are present in high-current plug-in connections, for example.

Fastenings between the contact carrier and the plug are discussed in DE 10 2004 024 530 A1, for example. Thus far, however, it has not been possible to achieve optimal minimization of the relative movement.

SUMMARY OF THE INVENTION

Therefore, there may be a need for an improved plug system and a corresponding manufacturing method for a plug system, which in particular allow a relative movement between an electrical contact and a pin to be minimized or prevented.

This need may be met by the subject matter of the present invention according to the descriptions herein. Advantageous specific embodiments of the present invention are described in the further descriptions herein.

Features, particulars, and possible advantages of a device according to specific embodiments of the present invention are discussed in greater detail below.

According to a first aspect of the present invention, a plug system for high-current plug-in connections is provided. The plug system includes a cable harness plug including an electrical line, and a unit including an interface for establishing an electrical connection between the cable harness plug and the unit. In addition, the plug system includes a first fixing element for fixing the cable harness plug to the interface in a form-locked manner. Furthermore, the plug system includes a second fixing element which is configured for fixing the cable harness plug and/or the line to the unit in a form-locked manner in such a way that a movement of the cable harness plug and/or of the line in parallel, and optionally at the same time also perpendicularly, to a mating direction of the cable harness plug is prevented.

In other words, the concept of the present invention is based on fixing the cable harness plug and the line, or only the cable harness plug or only the line, to the unit in such a way that a movement of the cable harness plug and of the line does not act on or is not transmitted to the contact. This means that the interface and the cable harness plug, and in particular the contact elements of the interface and of the cable harness plug which are in electrical contact, have the same vibration level.

The second fixing element fixes the line and/or the cable harness plug, without play, directly to the unit in addition to the actual plug-in locking by the first fixing element. The fixing with the aid of the second fixing element takes place, without play, at least in parallel to the mating direction. In other words, the plug-in connection may be axially fixed. In addition, the fixing by the second fixing element may also prevent a movement perpendicularly to the mating direction of the cable harness plug.

Due to the fixing of the cable harness plug and/or of the line directly to the unit, these components are at the same vibration level as the unit and the interface provided on the unit. Transmission of the movement to the contact is reduced in this way. The relative movement between the contact and the pin is thus decreased. In addition, the wear on the contact carrier is thus reduced, and the service life of the plug system is increased.

The plug system may be used in motor vehicles, for example. A cable harness of the motor vehicle may include an electrical line or a cable, and a cable harness plug at one end of the electrical line. For example, the cable harness plug may be connected via the electrical line to components of the motor vehicle, for example a control unit.

The cable harness plug may include a housing, within which a contact carrier including one or multiple contact elements is situated. The contact elements of the cable harness plug may establish an electrical connection with contact elements situated on the interface.

The unit, on which the interface is provided, which is to be connected to the cable harness plug, may be configured, for example, as a further cable harness, as a circuit board, or as a distributor. The unit may be configured as an electric machine or as the housing of an electric machine.

An interface via which the unit is connectable to the cable harness plug, and thus to further components, is provided on the unit. For example, the unit may be supplied with power via the interface. The interface may include an interface socket or a plug collar. Contact elements such as blades or pins, for example, may be provided in the plug collar.

The first fixing element is used for directly fastening the cable harness plug to the interface or to the interface collar. The first fixing element may also be referred to as a plug lock. For example, the first fixing element may be manually actuated. After the cable harness plug is connected to the interface, i.e., after the cable harness plug is inserted into the interface socket, the first fixing element may be actuated and the cable harness plug may be fixed to the interface or to the interface socket in a form-locked, and optionally a force-fit, manner. For this purpose, two oppositely situated locking pins may be situated, perpendicularly with respect to the mating direction of the cable harness plug, on the outside of the interface socket, for example. The first fixing element may be configured as a slide element or as a rotatably supported lever element. In particular, the first fixing element may be situated on the cable harness plug.

The second fixing element is used for directly or indirectly fastening the cable harness plug and/or the electrical line to the unit. In particular, the cable harness plug as well as the electrical line may be fixed to the unit via the second fixing element. Alternatively, only one of these elements may be fixed to the unit. The fixing may be form-locked, or both form-locked and force-fit. For example, the fastening by the second fixing element may take place at a predefined distance from the interface. For example, the predefined distance may be less than 100 mm, in particular less than 50 mm, and which may be less than 30 mm.

The second fixing element fixes the electrical line and/or the cable harness plug in parallel to the mating direction of the cable harness plug. This means that a movement in or against the mating direction is prevented. The mating direction may extend in parallel to a longitudinal axis of the cable harness plug. The second fixing element may have a design similar to the first fixing element. The second fixing element may be configured to be manually mountable and manually actuatable.

The second fixing element may be actuated after the cable harness plug is connected to the interface, and after or before the first fixing element is closed. The second fixing element may already be mounted on the cable harness plug, or may be configured as a separate component. In addition, the second fixing element may be configured as a slide element or as a rotatably supported lever element.

According to one exemplary embodiment of the present invention, the second fixing element is configured as a quick-release closure. The quick-release closure may be configured as a manually actuatable lever closure or slide closure, and may be detachable multiple times. In addition, the quick-release closure may be configured as a snap-lock closure. Furthermore, the quick-release closure may be spring-loaded and held in the closed position by the spring after closing. Moreover, the quick-release closure may automatically close after actuation. The first fixing element may also optionally be configured as a quick-release closure.

The time for installing the cable harness at the interface may be significantly reduced by using a quick-release closure. In addition, the use of additional tools, such as screwdrivers, during assembly may be dispensed with. The required installation space in the vehicle may thus be reduced.

According to another exemplary embodiment of the present invention, a locking element is provided on the unit. The second fixing element is configured for engaging in a form-locked manner with the locking element in such a way that the second fixing element is fixed to the unit in a form-locked manner. The locking element may be configured, for example, as one or multiple pins, engagement hooks, or protrusions. The second fixing element may include a hook, for example, which engages behind the locking element.

According to another exemplary embodiment of the present invention, the locking element is configured in the form of two oppositely situated locking pins which face away from the unit, perpendicularly with respect to the mating direction.

According to another exemplary embodiment of the present invention, the second fixing element is situated on the cable harness plug. In addition, the second fixing element is supported so that it is rotatable about a rotational axis extending through the cable harness plug, perpendicularly with respect to the mating direction. In this specific embodiment, the second fixing element is not configured to be separate from the cable harness plug, and instead is premounted on same. In this exemplary embodiment, it is possible for only the cable harness plug to be fixed directly to the unit via the second fixing element.

If, for example, a lever on the side of the second fixing element facing away from the unit is actuated, the second fixing element rotates about the rotational axis on the cable harness plug. In the process, a hook of the second fixing element engages behind a locking element or behind a protrusion on the unit, thus fixing the cable harness plug and optionally also the electrical line to the unit. Alternatively, the second fixing element may be configured as a slider which is moved in a plane perpendicularly to the mating direction.

According to another exemplary embodiment of the present invention, the second fixing element is configured as a separate component. The second fixing element includes a base body and a rotatable body. The rotatable body is configured to be movable relative to the base body. In particular, the rotatable body may include an actuating lever and an engagement hook. The second fixing element may be manufactured separately from the cable harness plug. Prior to assembly, the second fixing element is situated neither on the unit nor on the cable harness plug.

According to another exemplary embodiment of the present invention, the base body includes a first engagement element. The cable harness plug also includes an accommodation element. The first engagement element engages in a form-locked manner with the accommodation element when the second fixing element is fixed to the unit.

The accommodation element may be configured, for example, as a bulge, a recess, or an indentation on the cable harness plug. The first engagement element may be configured as a protrusion or elevation on the base body. The shape of the engagement element corresponds to the shape of the accommodation element. During assembly, the first engagement element of the base body is inserted into the accommodation element before the fixing element is actuated. A secure seat of the separate second fixing element on the cable harness plug may thus be ensured.

According to another exemplary embodiment of the present invention, the base body also includes a second engagement element. The unit includes a pressing element. The second engagement element presses the electrical line against the pressing element when the second fixing element is fixed to the unit.

The pressing element may be configured, for example, as an elevation or as a protrusion on the unit. The second engagement element, similarly to the first engagement element, may be configured as an elevation or protrusion. During assembly, the separate second fixing element together with the first engagement element is inserted into the accommodation element on the cable harness plug. In addition, the second engagement element presses the electrical line against the pressing element. The electrical line as well as the cable harness plug are thus fixed directly to the unit. The second engagement element as well as the pressing element may have a rough or corrugated surface to prevent the line from slipping.

According to another exemplary embodiment of the present invention, the base body is configured for accommodating the line. The rotatable body fixes the second fixing element and the line accommodated in the base body to the unit in a form-locked manner when the second fixing element is mounted on the plug system.

In this exemplary embodiment, the second fixing element may be configured to be separate from the components of the plug system. It is possible for only the electrical line to be directly fixed to the unit via the second fixing element. The inner surface of the base body, in which the electrical line is accommodated, may have a rough design to prevent slippage of the line. For example, the inner surface of the base body may have a corrugated design.

During assembly, after a connection is established between the interface and the cable harness plug, the second fixing element is pushed over the electrical line in such a way that the electrical line is accommodated in the base body. The second fixing element is subsequently pressed against the unit or a pressing element. In addition, the rotatable body of the second fixing element is pushed against the base body in such a way that the second fixing element engages with a locking element on the unit and establishes a form-locked connection. The movement of the rotatable body may include a translational and/or a rotational motion.

According to a second aspect of the present invention, a method for manufacturing a plug system for high-current plug-in connections described above is provided. The method includes the following steps: providing a cable harness plug including an electrical line; providing a unit including an interface for establishing an electrical connection between the cable harness plug and the unit; fixing the cable harness plug to the interface in a form-locked manner with the aid of a first fixing element; fixing the cable harness plug and/or the line to the unit in a form-locked manner with the aid of a second fixing element in such a way that a movement of the cable harness plug and/or of the line in parallel, and optionally at the same time also perpendicularly, to a mating direction of the cable harness plug is prevented.

Further features and advantages of the present invention are apparent to those skilled in the art from the following description of examples of specific embodiments, which, however, are not to be construed as limiting to the present invention, with reference to the appended drawings.

All figures are merely schematic illustrations of devices according to the present invention or their components, according to exemplary embodiments of the present invention. In particular, distances and relative sizes are not depicted true to scale in the figures. Corresponding elements are provided with the same reference numerals in the various figures.

DETAILED DESCRIPTION

Figure 1A:
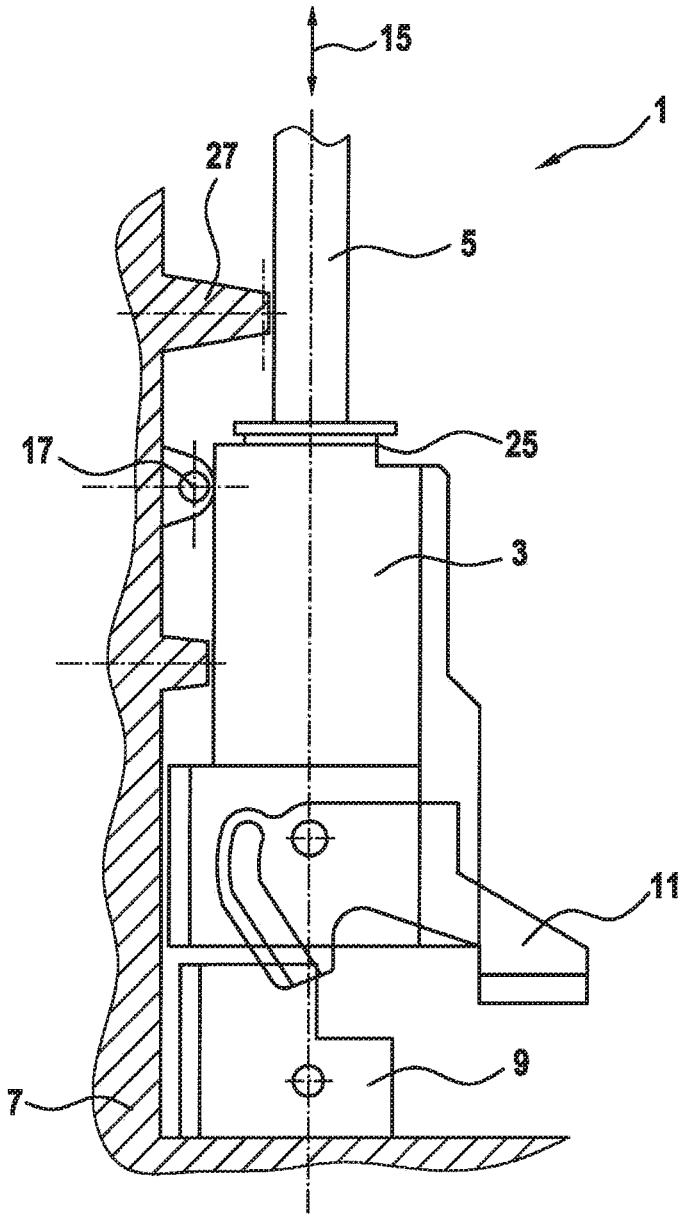
FIG. 1 shows side views of a plug system according to a first exemplary embodiment of the present invention, in different states.

The figures illustrate side views of various specific embodiments of plug system 1. Plug system 1 includes a cable harness plug 3 including an electrical line 5 or a cable. In addition, plug system 1 includes a unit 7 including an interface 9 for establishing an electrical connection between cable harness plug 3 and unit 7. Unit 7 may be an electric machine, for example. Interface 9 includes a plug collar or an interface socket into which cable harness plug 3 is insertable.

A first fixing element 11 is provided on cable harness plug 3. First fixing element 11 may be fastened on cable harness plug 3 so that the first fixing element is rotatable about an axis. First fixing element 11 may be configured as a locking lever between cable harness plug 3 and interface 9. First fixing element 11 fastens cable harness plug 3 to interface 9, without play, in a form-locked and optionally a force-fit manner. For this purpose, locking pins may be provided at interface 9 or at the outer periphery of the interface socket, perpendicularly with respect to mating direction 15 and facing away from interface 9, first fixing element 11 engaging with the locking pins, for example with the aid of an engagement hook, after the lever is actuated.

In addition, plug system 1 includes a second fixing element 13. Second fixing element 13 fixes electrical line 5 and/or cable harness plug 3, without play, directly to unit 7 in addition to the actual plug locking via first fixing element 11. As a result, interface 9 and cable harness plug 3 have the same vibration level, thus minimizing wear on the electrical contact elements of plug system 1.

Due to the fixing with the aid of the second contact element, a movement of cable harness plug 3 and/or of line 5 in parallel to mating direction 15 of cable harness plug 3 is prevented. A locking element 17 may be provided on unit 7 for this purpose. Locking element 17 may be configured as a pin or as an engagement hook. In particular, locking element 17 may be configured in the form of two locking pins situated perpendicularly on unit 7, opposite from one another with respect to mating direction 15. In all exemplary embodiments, second fixing element 13 is configured as a quick-release closure, as the result of which installation time and installation space may be saved.

In plug systems 1 shown in FIGS. 1 and 3, second fixing element 13 is configured to be separate from the other components of plug system 1. In contrast, in the exemplary embodiment in FIG. 2, the second fixing element is rotatably mounted on cable harness plug 3. Second fixing element 13 shown in FIG. 1 fixes electrical line 5 as well as cable harness plug 3 directly to unit 7. Second fixing element 13 illustrated in FIG. 2 fixes only cable harness plug 3 directly to unit 7. In contrast, second fixing element 13 shown in FIG. 3 fixes only electrical line 5 directly to unit 7.

FIG. 1 illustrates different positions or closing states of plug system 1 according to a first exemplary embodiment. FIG. 1A shows plug system 1 in an attachment position without second fixing element 13. Cable harness plug 3 is guided on unit 7 and situated opposite from interface 9. However, the electrical contact elements of interface 9 and of cable harness plug 3 are not yet in electrical contact. In addition, first fixing element 11 is in an open position. Protrusions on which cable harness plug 3 and electrical line 5 may be aligned and positioned are provided on unit 7. These protrusions may also provide a connection geometry for second fixing element 13.

Figure 1B:
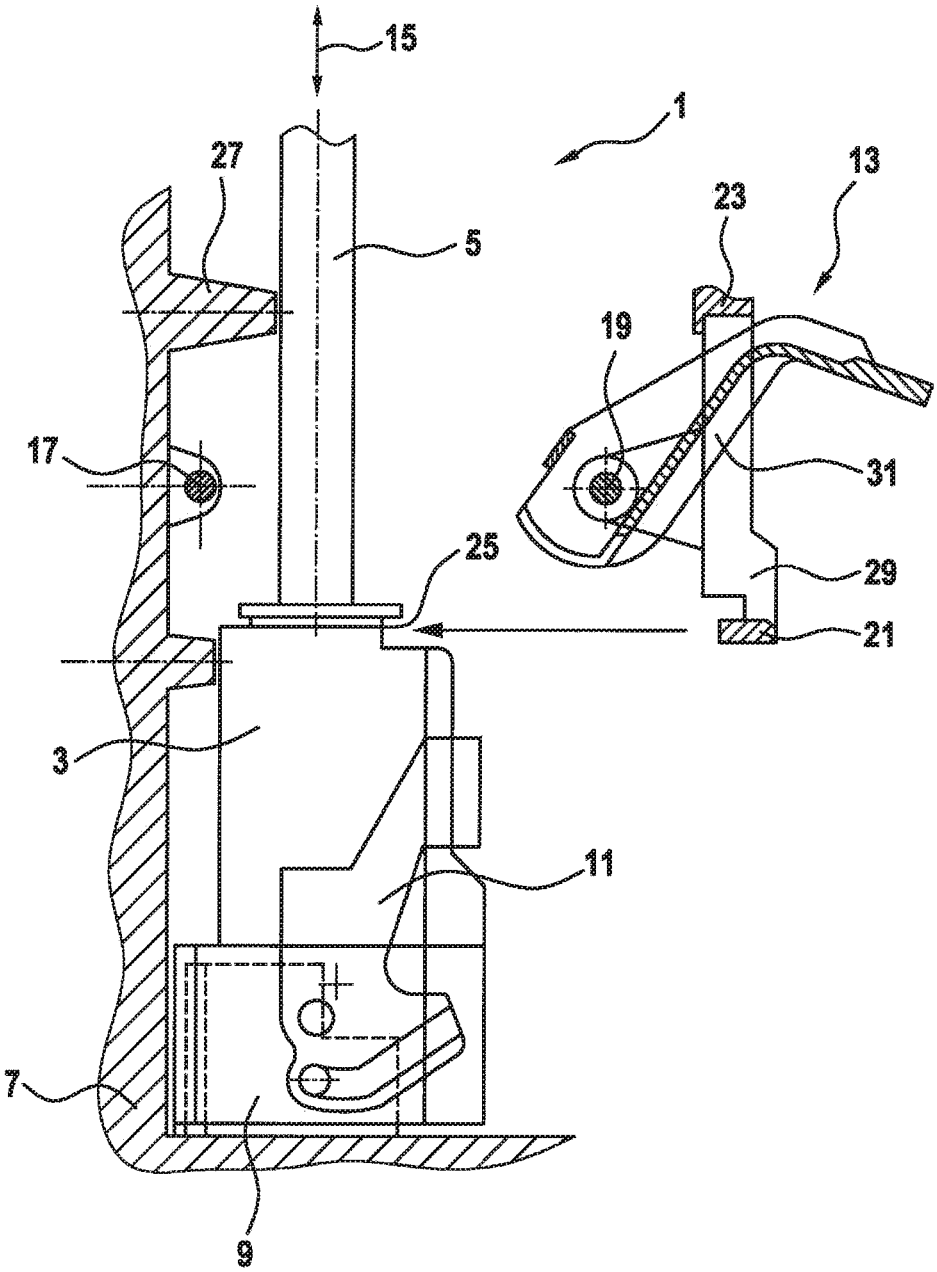

Cable harness plug 3 and the interface collar are plugged together in FIG. 1B. This means that the plug-in connection is closed. In addition, first fixing element 11 is closed, so that cable harness plug 3 is connected to interface 9 without play. Second fixing element 13, which is configured to be separate from the components of the plug system, is open and in an attachment position.

Second fixing element 13 shown in the exemplary embodiment in FIG. 1 includes a base body 29 and a rotatable body 31. Rotatable body 31 is supported so that it is movable with respect to base body 29. In particular, rotatable body 31 is mounted on base body 29 so that the former is rotatable about a rotational axis 19. Base body 29 includes a first engagement element 21 and a second engagement element 23. In addition, an accommodation element 25, which is configured for accommodating first engagement element 21, is provided on cable harness plug 3.

Figure 1C:
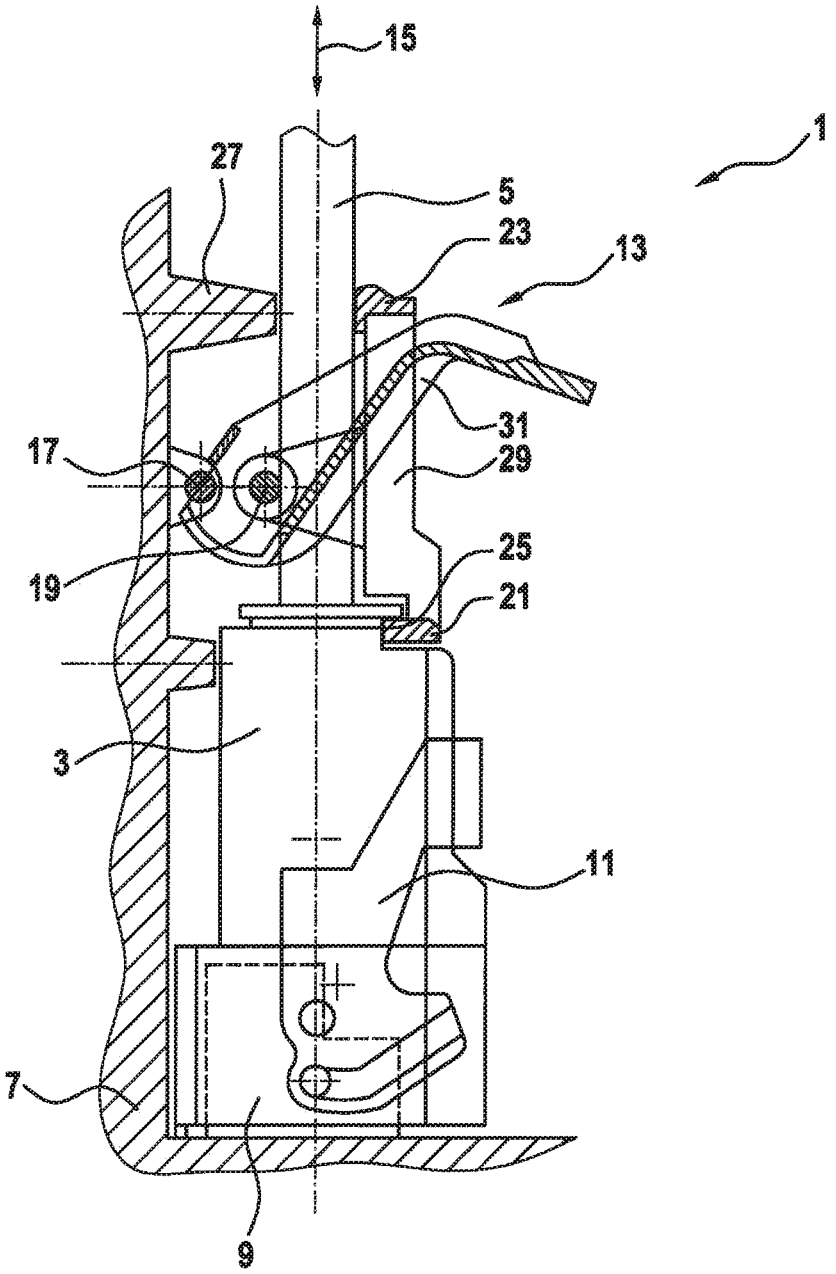
Figure 1D:
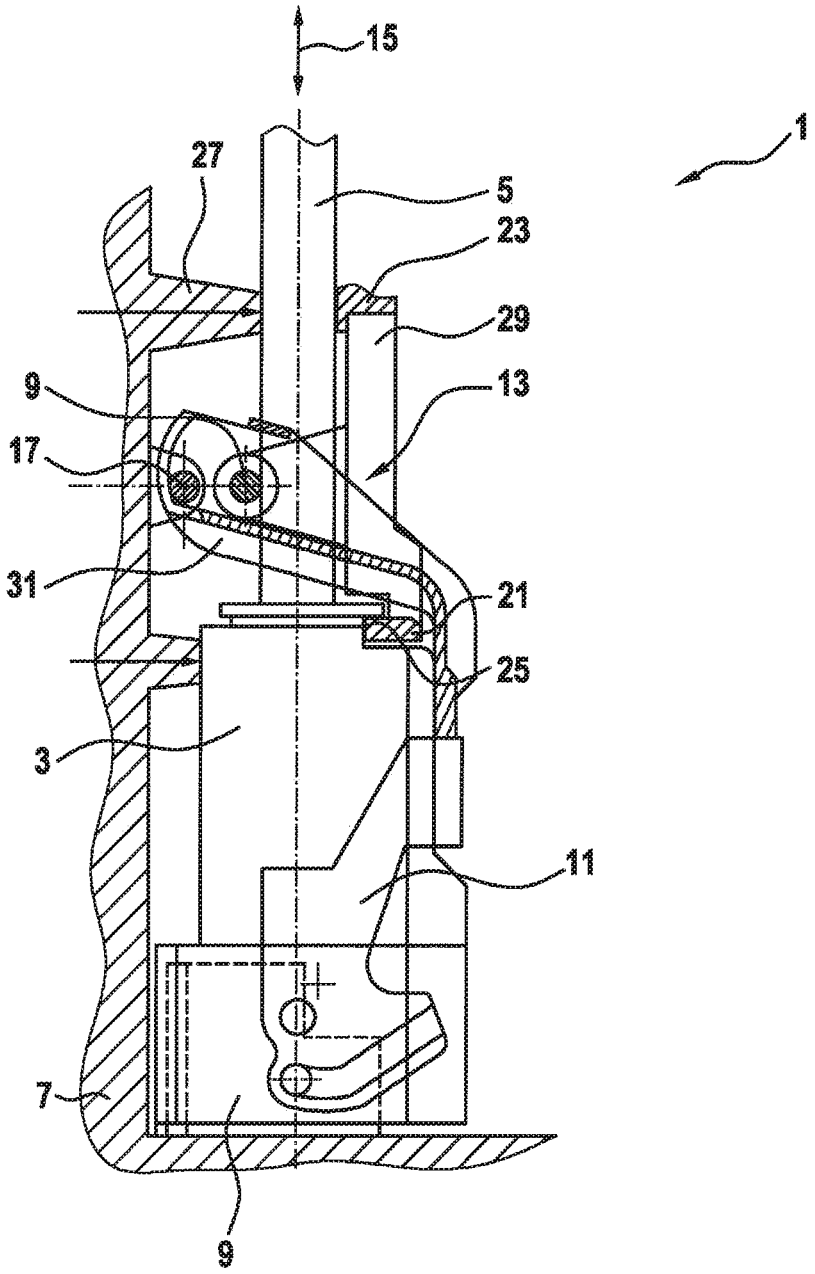

As illustrated in FIG. 1C, accommodation element 25 cooperates with first engagement element 21 in order to position and align second fixing element 13. In addition, a pressing element 27 in the form of an elevation, optionally with a rough surface, is provided on unit 7. If second fixing element 13 is actuated by rotating rotatable body 31 about rotational axis 19 and transferred into the closed position, as shown in FIG. 1D, second engagement element 23 presses electrical line 5 against pressing element 27. This is indicated by arrows in FIG. 1D. At the same time, cable harness plug 3 is also fixed to unit 7 in a form-locked, and optionally a force-fit, manner. This is also indicated by arrows in FIG. 1D.

Figure 2A:
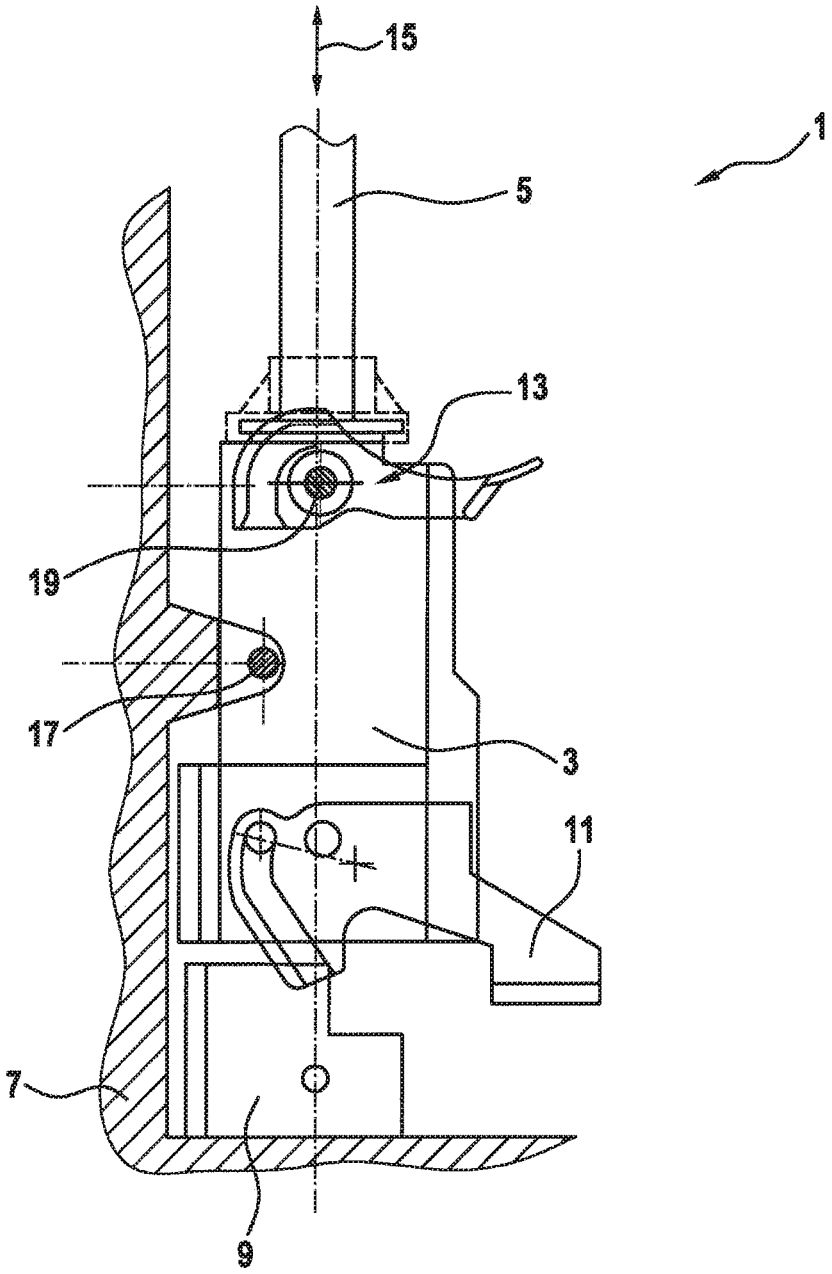
FIG. 2 shows side views of a plug system according to a second exemplary embodiment of the present invention, in different states.

FIG. 2 illustrates different positions or closing states of plug system 1 according to a second exemplary embodiment. In this exemplary embodiment, second fixing element 13, in contrast to FIGS. 1 and 3, is premounted on cable harness plug 3 and supported so that it is rotatable about a rotational axis 19. In addition, in this embodiment, in contrast to the embodiments in FIGS. 1 and 3, second fixing element 13 includes no base body, but, rather, includes only a rotatable body which is mounted directly on the cable harness plug. In FIG. 2A the plug-in connection is open and, similarly to FIG. 1A, is in the attachment position. First fixing element 11 as well as second fixing element 13 are in an open position.

Figure 2B:
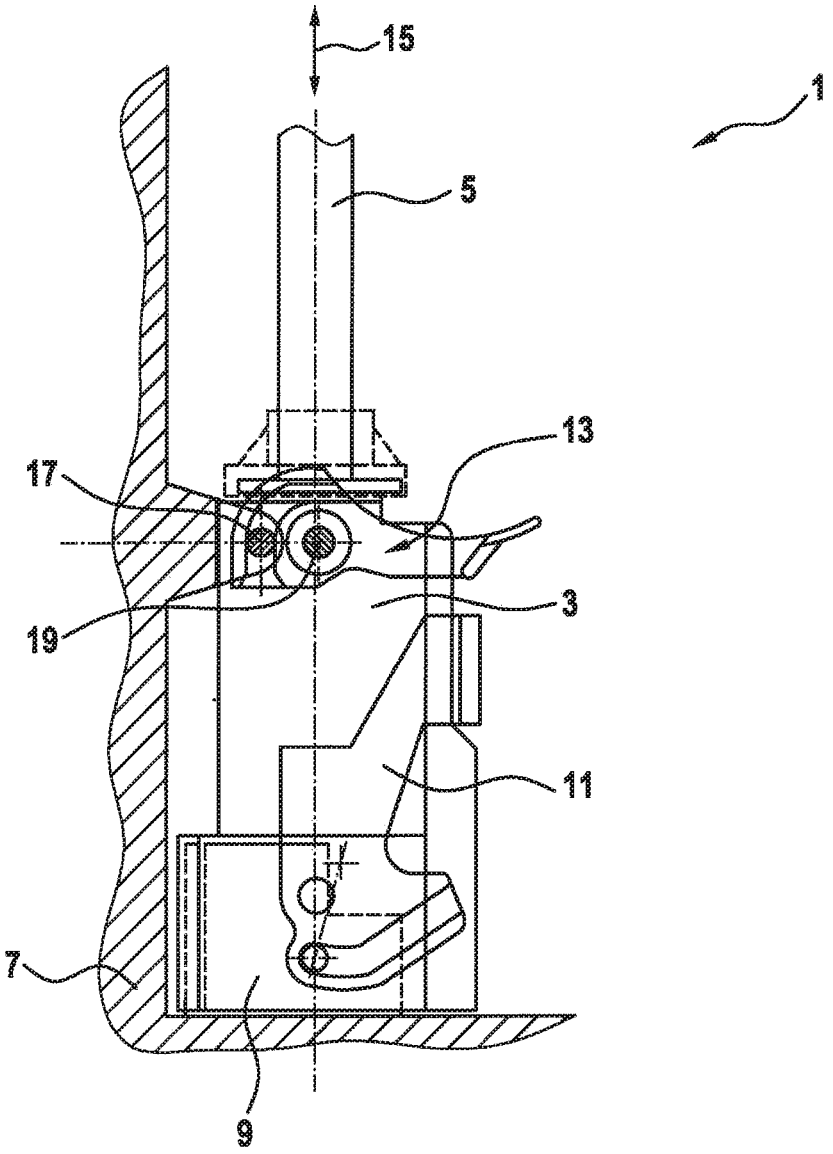
Figure 2C:
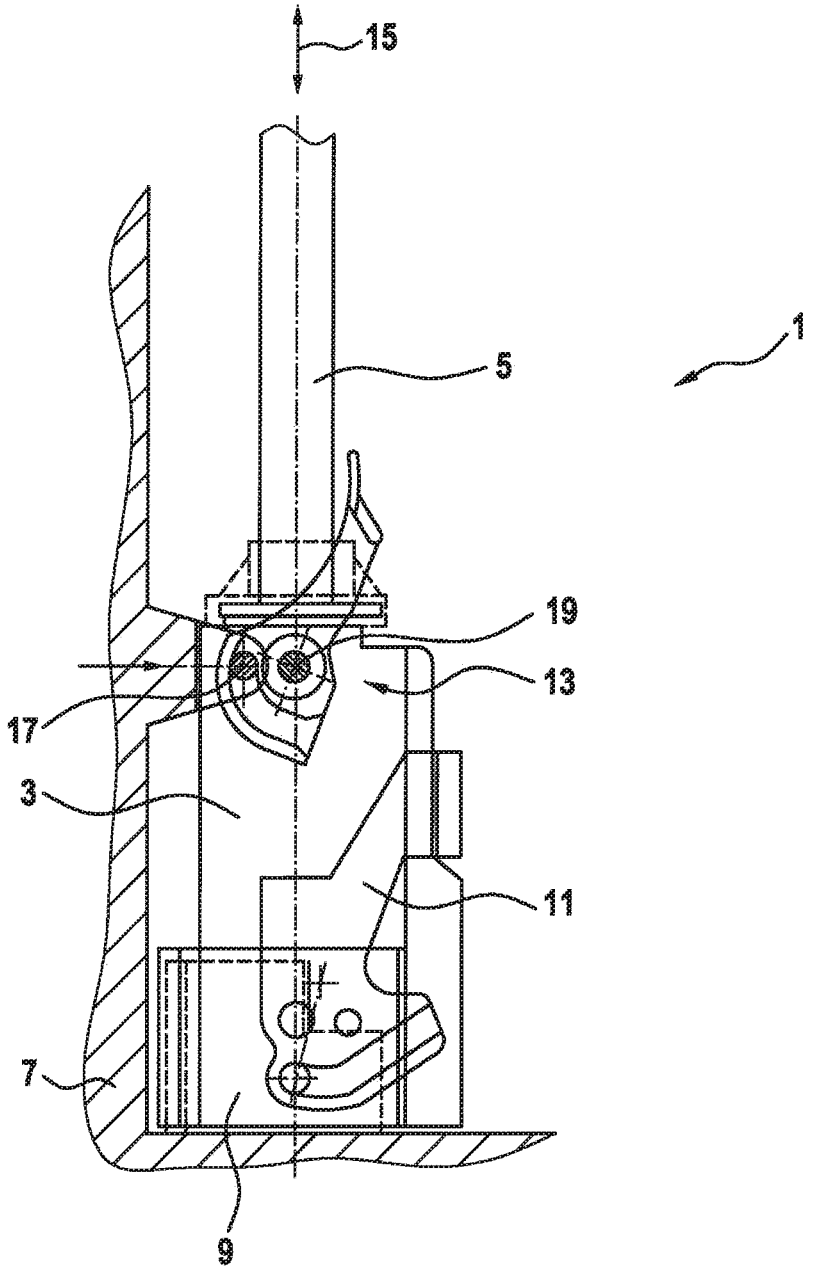

Cable harness plug 3 and the interface collar, similarly to FIG. 1B, are plugged together and first fixing element 11 is closed in FIG. 2B. Second fixing element 13 is open, and is loosely engaged on or in locking element 17. Second fixing element 13 is actuated or closed in FIG. 2C, so that locking element 17 engages in a form-locked manner with a slot on second fixing element 13. In this way, second fixing element 13 mounted on cable harness plug 3 fixes cable harness plug 3 to unit 7 in a form-locked, and optionally a force-fit, manner.

Figure 3A:
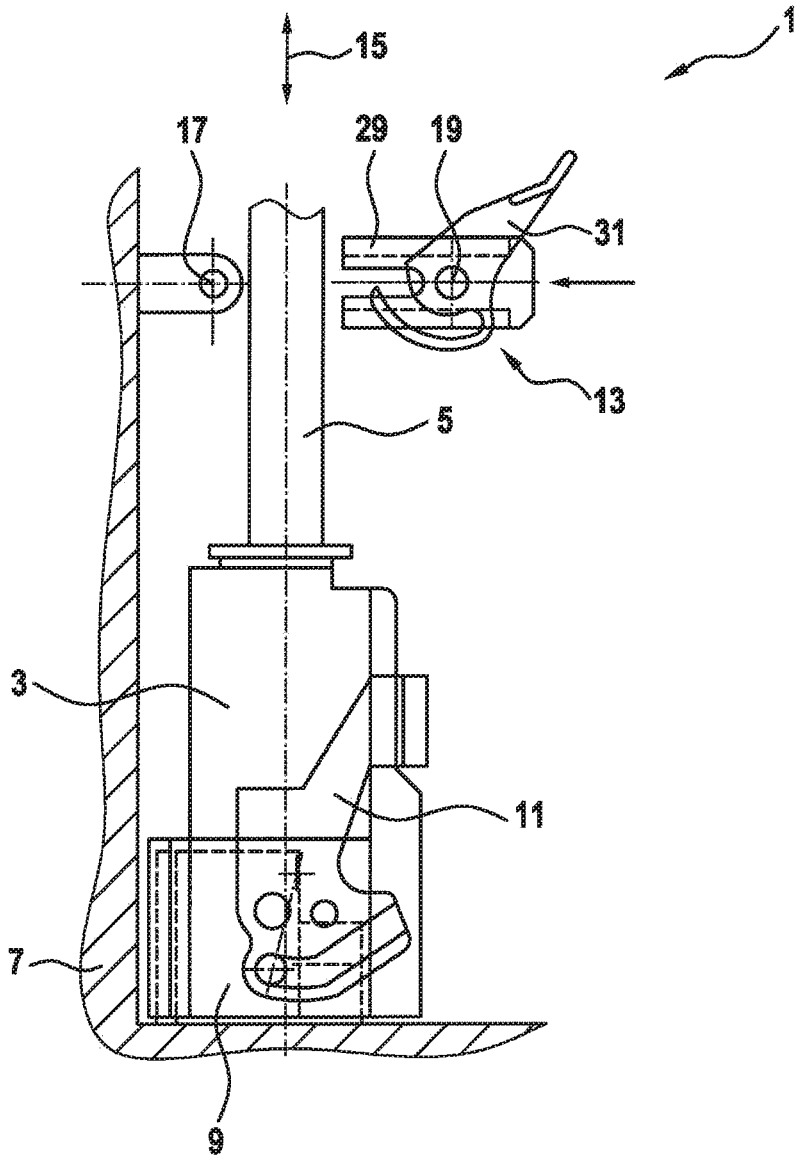
FIG. 3 shows side views of a plug system according to a third exemplary embodiment of the present invention, in different states.
Figure 3B:
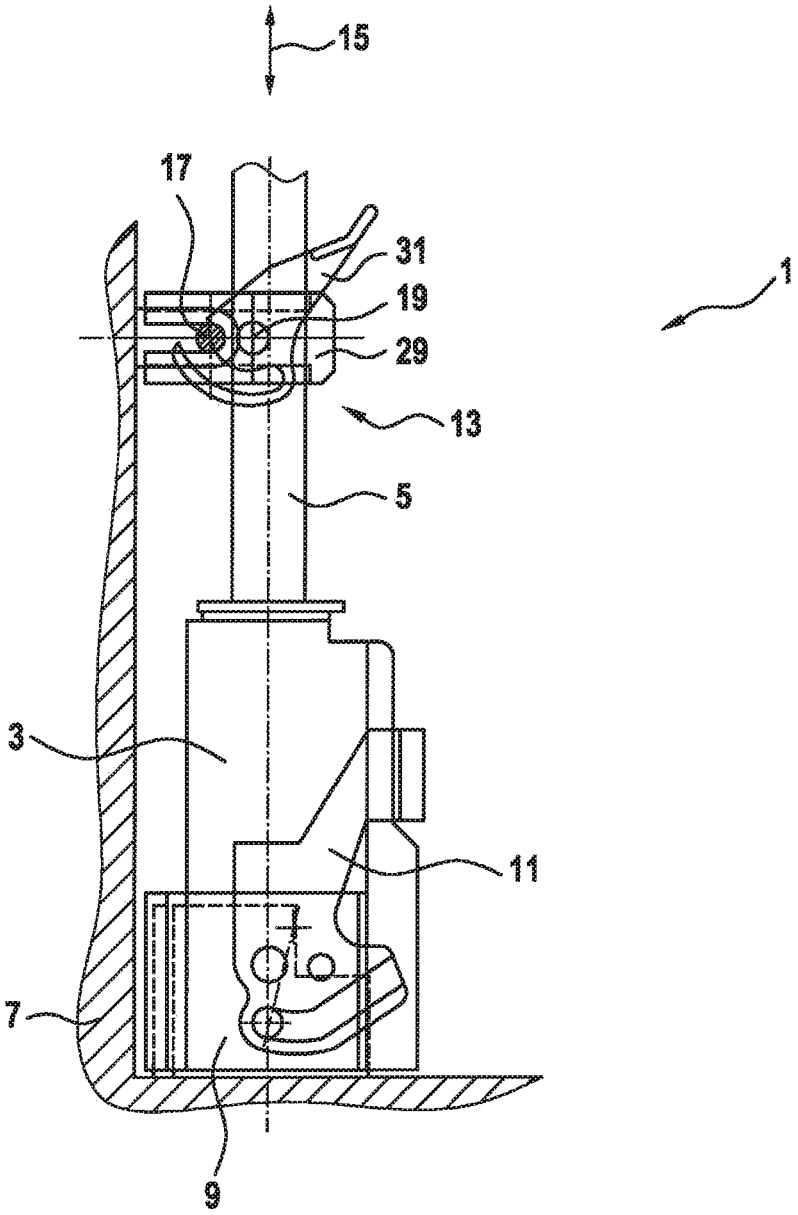
Figure 3C:
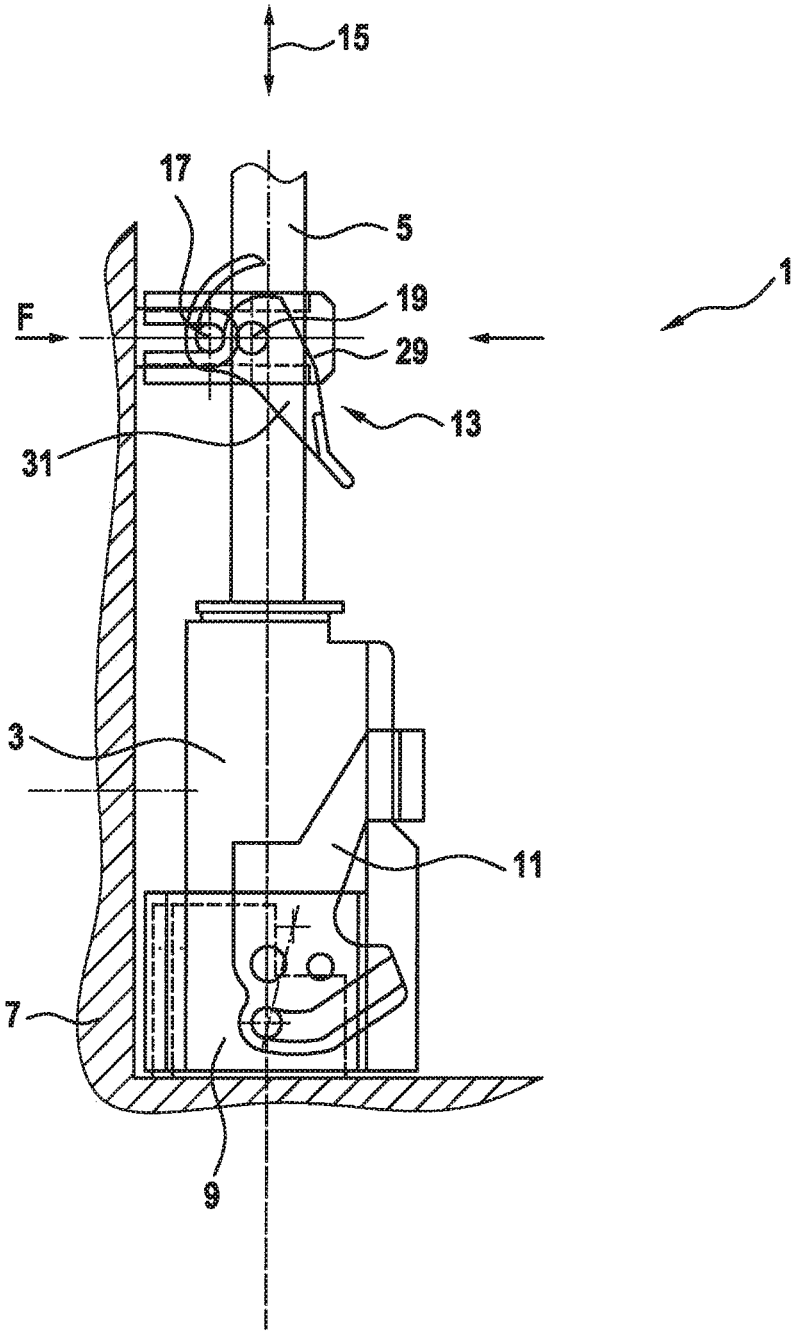

FIG. 3 illustrates different positions or closing states of plug system 1 according to a third exemplary embodiment. Second fixing element 13, similarly to FIG. 1, is configured as a separate component. Base body 29 of second fixing element 13 is configured for accommodating electrical line 5. The plug-in connection is closed in FIG. 3A. In addition, first fixing element 11 is in a closed position. Second fixing element 13 is in an attachment position and is open. Second fixing element 13, in comparison to the exemplary embodiment in FIG. 1, is attached at a greater distance on line 5. In FIG. 3B, second fixing element 13 is pushed onto line 5 in such a way that line 5 is accommodated in base body 29. Second fixing element 13 is closed in FIG. 3C, so that a slot in rotatable body 31 engages with locking element 17 on unit 7, and line 5 is fixed to unit 7 in a form-locked, and optionally a force-fit, manner.

In conclusion, it is noted that expressions such as "including" or the like are not intended to rule out that further elements or steps may be provided. In addition, it is pointed out that "a" or an do not exclude a plurality.

Furthermore, features described in conjunction with the various specific embodiments may be arbitrarily combined with one another. Moreover, it is noted that any reference numerals in the claims are not to be construed as limiting their scope.

What is claimed is:

1. A plug system for a high-current plug-in connection, comprising:

a cable harness plug including an electrical line;

a unit including an interface for establishing an electrical connection between the cable harness plug and the unit;

a first fixing element, fastened on the cable harness plug and rotatable about an axis, to fix the cable harness plug to the interface in a form-locked manner; and a second fixing element to fix the cable harness plug and/or the line to the unit in a second form-locked manner so that a movement of the cable harness plug and/or of the line in parallel to a mating direction of the cable harness plug is prevented, wherein the second fixing element is detachable from the cable harness plug and unit, and the second fixing element includes a base body and a rotatable body, the rotatable body being rotatable relative to the base body.

2. The plug system of claim 1, wherein the second fixing element includes a quick-release closure.

3. The plug system of claim 1, wherein there is a locking element on the unit, and wherein the second fixing element is configured to engage in the second form-locked manner with the locking element so that the second fixing element is fixed to the unit in the second form-locked manner.

4. The plug system of claim 3, wherein the locking element includes two oppositely situated locking pins which are perpendicular with respect to the mating direction and face away from the unit.

5. The plug system of claim 1, wherein the second fixing element is situated on the cable harness plug, and wherein the second fixing element is supported so that it is rotatable about a second axis which extends through the cable harness plug, perpendicularly with respect to the mating direction.

6. The plug system of claim 1, wherein there is a first engagement element on the base body, wherein the cable harness plug includes an accommodation element, and wherein the first engagement element engages in a form-locked manner with the accommodation element when the second fixing element is fixed to the unit.

7. The plug system of claim 1, wherein the base body is configured to accommodate the electrical line, and wherein the rotatable body fixes the second fixing element and the electrical line accommodated in the base body to the unit in a form-locked manner.

8. The plug system of claim 1, wherein the second fixing element fixes the cable harness plug and the line to the unit in the second form-locked manner so that the movement of the cable harness plug and of the line in parallel to the mating direction of the cable harness plug is prevented.

9. The plug system of claim 1, wherein the rotatable body is rotatable about a second axis different from the axis about which the first fixing element is rotatable.

10. The plug system of claim 1, wherein the unit includes a locking element to engage the second fixing element.

11. The plug system of claim 10, wherein the locking element includes a pin extending perpendicular to the mating direction of the cable harness plug to the unit.

12. The plug system of claim 1, wherein the unit includes protrusions on which cable harness plug and line are aligned.

13. The plug system of claim 1, wherein the second fixing element includes a first engagement element that engages with a corresponding engagement element on the plug.

14. The plug system of claim 13, wherein the second fixing element includes a second engagement element that engages with a corresponding engagement element on the unit.

15. A plug system for a high-current plug-in connection, comprising:

a cable harness plug including an electrical line;

a unit including an interface for establishing an electrical connection between the cable harness plug and the unit;

a first fixing element to fix the cable harness plug to the interface in a form-locked manner; and a second fixing element to fix the cable harness plug and/or the line to the unit in a form-locked manner so that a movement of the cable harness plug and/or of the line in parallel to a mating direction of the cable harness plug is prevented, wherein the second fixing element includes a separate component, wherein the second fixing element includes a base body and a rotatable body, and wherein the rotatable body is movable relative to the base body, and wherein there is a second engagement element on the base body, wherein the unit includes a pressing element, and wherein the second engagement element presses the electrical line against the pressing element when the second fixing element is fixed to the unit.

16. A method for manufacturing a plug system for a high-current plug-in connection, the method comprising:

providing a cable harness plug including an electrical line;

providing a unit including an interface for establishing an electrical connection between the cable harness plug and the unit;

fixing the cable harness plug to the interface in a form-locked manner with a first fixing element fastened on the cable harness plug and rotatable about an axis; and fixing the cable harness plug and/or the line to the unit in a second form-locked manner with a second fixing element so that a movement of the cable harness plug and/or of the line in parallel to a mating direction of the cable harness plug is prevented, wherein the second fixing element is detachable from the cable harness plug and unit, and the second fixing element includes a base body and a rotatable body, the rotatable body being rotatable relative to the base body.

17. A plug system for a high-current plug-in connection, comprising:

a cable harness plug including an electrical line;

a unit including an interface for establishing an electrical connection between the cable harness plug and the unit;

a first fixing element to fix the cable harness plug to the interface in a form-locked manner; and a second fixing element to fix the cable harness plug and/or the line to the unit in a form-locked manner so that a movement of the cable harness plug and/or of the line in parallel to a mating direction of the cable harness plug is prevented, wherein the second fixing element is detachable from the cable harness plug and unit, wherein the second fixing element includes a base body and a rotatable body, and wherein the rotatable body is movable relative to the base body, and wherein the first fixing element includes a locking lever, locking pins are provided on the unit, and the locking lever engages the locking pins.

18. The plug system of claim 17, wherein the rotatable body is rotatable relative to the base body.

* * * * *